US010605445B1

(12) United States Patent
Purbaugh

(10) Patent No.: US 10,605,445 B1
(45) Date of Patent: Mar. 31, 2020

(54) LED CONTROLLER

(71) Applicant: Zivelo Inc., Scottsdale, AZ (US)

(72) Inventor: Cole Purbaugh, Scottsdale, AZ (US)

(73) Assignee: Zivelo Inc., Scottsdale, AZ (US)

( * ) Notice: Subject to any disclaimer, the term of this patent is extended or adjusted under 35 U.S.C. 154(b) by 0 days.

(21) Appl. No.: 16/201,020

(22) Filed: Nov. 27, 2018

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***F21V 23/00*** | (2015.01) |
| ***H05B 33/08*** | (2020.01) |
| ***F21V 23/06*** | (2006.01) |
| ***F21V 23/04*** | (2006.01) |
| ***F21V 29/70*** | (2015.01) |
| *F21Y 105/10* | (2016.01) |
| *F21Y 115/10* | (2016.01) |

(52) U.S. Cl.
CPC ..... *F21V 23/006* (2013.01); *F21V 23/001* (2013.01); *F21V 23/04* (2013.01); *F21V 23/06* (2013.01); *F21V 29/70* (2015.01); *H05B 33/0806* (2013.01); *H05B 33/0845* (2013.01); *F21Y 2105/10* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2009/0059605 | A1* | 3/2009 | Xu | F21K 9/00 362/373 |
| 2010/0220469 | A1* | 9/2010 | Ivey | F21K 9/27 362/218 |
| 2013/0223053 | A1* | 8/2013 | Liu | H01R 12/732 362/217.17 |
| 2015/0312995 | A1* | 10/2015 | Bora | H05B 33/0863 315/34 |

* cited by examiner

*Primary Examiner* — Anh Q Tran
(74) *Attorney, Agent, or Firm* — Greenberg Traurig, LLP

(57) ABSTRACT

A light emitting diode (LED) controller includes a substantially flat circuit board having a first surface and an oppositely disposed second surface. A microprocessor and a first driver module are mounted on the first surface, the first driver module being configured to receive first control signals from the microprocessor and to generate second control signals. A second driver module is mounted on the second surface and configured to receive the second control signals from the first driver module and to generate third control signals. An LED controller terminal end is configured to apply the third control signals to an LED strip.

19 Claims, 10 Drawing Sheets

LED CONTROLLER

TECHNICAL FIELD

The present invention relates, generally, to LED (light emitting diode) controllers and, more particularly, to an LED controller configured to interface with an off-the-shelf LED strip.

BACKGROUND

Single and multi-color LED strips provide illumination and ornamentation for safety, emergency preparedness, alerts, accent lighting, and pedestrian and vehicular navigation. Flexible LED lighting strips are commonly used to enhance the aesthetic appeal of vehicle interiors and exteriors, as backlights for signage, to provide soft light for make-up mirrors, as emergency lighting in stairwells, to define passenger walkways inside aircraft, busses, trains, and shuttles, to indicate step heights and other structural boundaries, and as digital and/or analog status indicators and alerts for computers and other electronic systems.

Presently known LED strips typically comprise a linear array of individual LEDs embedded within a flexible strip. The terminal end of the strip includes connective lead lines (wires) extending from the strip, to which predetermined voltage signals are applied to thereby power one or more color channels (typically red, green, blue, and optionally white). When installed into the operating environment, the lead wires may be soldered or otherwise electromechanically coupled to corresponding conductive pods of an LED controller, either directly or via an interface connector. The LED controller includes a suitable microprocessor, such as the SAMD21 ARM® Cortex® ⁻MO+ series of microcontrollers available from Microchip Technologies under the tradename Atmel SMART™ SAM D21.

Presently known LED controllers are disadvantageous in that they often require ad hoc programming I/O and mounting hardware, driver circuitry, and heat sinks, none of which are defined by current IEEE or other industry standards. As a result, the design and installation of LED strips and associated LED controllers can be cumbersome and time consuming.

Moreover, presently known LED controllers typically require a housing to which thermal energy generated by the device is transferred. This limits the manner and environment in which LED controllers may be installed.

LED controllers and associated installation assemblies and methods are thus needed which overcome the shortcomings of the prior art.

BRIEF SUMMARY

The present invention provides an LED controller and LED strip assembly which overcomes the shortcomings of presently known systems. In an embodiment, the LED controller includes dimmer switches (power modulators) mounted to a bottom surface thereof to facilitate thermal bonding to a heat sink. The LED controller may be secured to the LED strip, and both devices attached to a common heat sink, such as a conventional aluminum rail. The LED controller may be attached to the rail using thermal adhesive (e.g., thermal tape).

Various other embodiments, aspects and features are of the present invention are described in more detail below. Additional features and characteristics will become apparent from the subsequent detailed description and the appended claims, taken in conjunction with the accompanying drawings and this background section.

BRIEF DESCRIPTION OF THE DRAWING FIGURES

Exemplary embodiments will hereinafter be described in conjunction with the following drawing figures, wherein like numerals denote like elements, and:

DETAILED DESCRIPTION OF PREFERRED EXEMPLARY EMBODIMENTS

Figure 1:
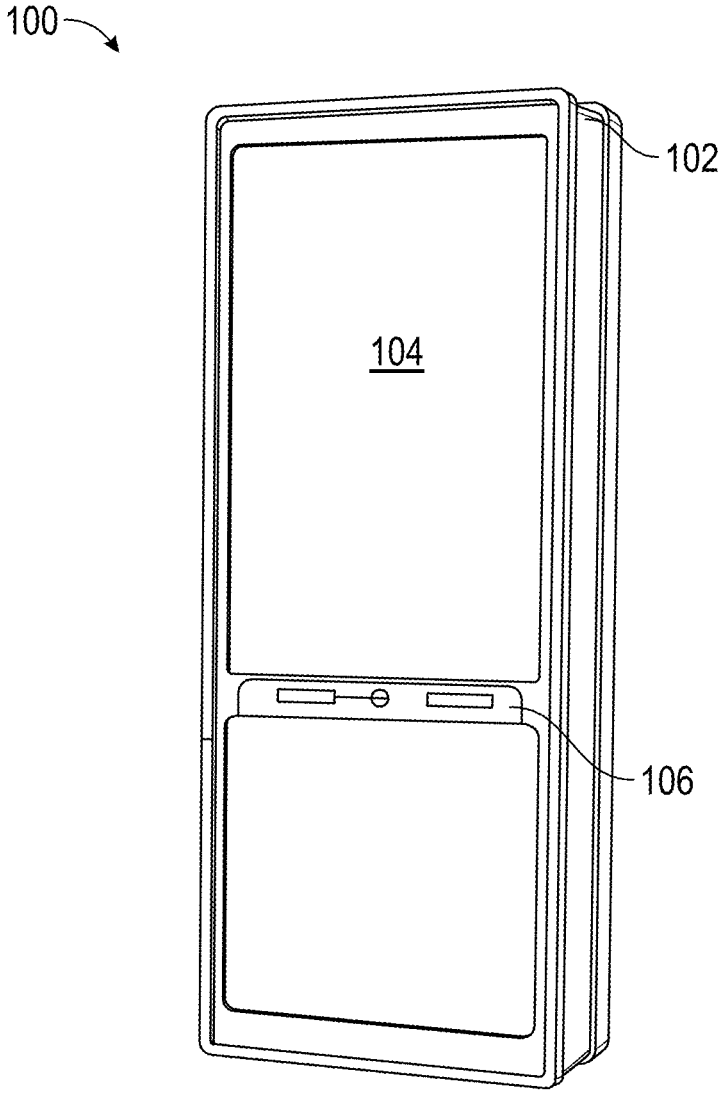
FIG. 1 is a perspective view of an kiosk illustrating an exemplary location for an LED assembly in accordance with various embodiments.

The following detailed description is merely exemplary in nature and is not intended to limit the scope of the invention or the application and uses of the invention. Furthermore, there is no intention to be bound by any theory presented in the preceding background or in the following detailed description.

Various embodiments of the following discussion relate to an LED controller for use with LED strips, including in connection with interactive kiosks and other devices, systems, and structures which may be equipped with LED strips.

A typical LED strip includes, for each of a plurality of LEDs, a common voltage source for supplying power to respective blue, green, and red diodes to thereby control the brightness of each diode and, hence, the color intensity of each LED.

The present invention relates to a control module for applying command and control signals to the various channels on the LED strip to determine the aggregate color and brightness of the LEDs on the strip, for example, using a laptop, desktop, or hand held computer connected to the controller, for example through a USB port. Alternatively, the signals may be applied remotely (e.g., wirelessly). A limiting resistor (also referred to herein as a current limiting resistor, dimmer, dimmer switch, or variable rheostat) steps down the applied voltage to a predetermined level so that the desired current flows through the diode, thereby determining the wavelength of light emitted by the diode. The resultant voltage applied to the diode determines its color; the brightness may be controlled by the duty cycle of the applied voltage, for example, using suitable modulation techniques.

According to one aspect of the invention, the brightness of each LED is controlled through pulse width modulation (PWM), for example using eight (8) bit modulation. In this way, 256 brightness levels may be displayed depending on the duty cycle of the applied PWM signal.

In an embodiment, the controller is configured to apply voltage control signals to the LED strip in a format which includes discrete values corresponding to the desired brightness level for each diode channel (e.g., red, green, blue, and white) during the upcoming data cycle, along with a transition duration which defines the time period during which the LEDs transition from a current brightness level (in the current cycle), to a subsequent brightness level in the next cycle. By way of illustration, a very short transition duration would produce an abrupt change from a first brightness level in the current data cycle to a second brightness level in the next data cycle. In contrast, a longer duration yields a more gradual brightness/color transition.

The controller may include a terminal interface having output pads configured to be soldered to corresponding lead lines associated with the LED strip. Alternatively, the controller can connect to the LED strip using circuit blocks whereby the lead wires from the LED strip are placed within conductive blocks disposed on the controller module, and snap fit, screwed, or otherwise secured to provide mechanical and electrical connectivity. In an embodiment, the pads of the terminal block exhibit substantially the same pitch as the LED wires.

One advantage of the subject LED controller surrounds the ability to quickly replace an LED strip in the field to minimize down time of equipment utilizing the LED strip. That is, rather than attempting to diagnose and repair a faulty LED strip, it can simply be replaced with an interchangeable plug-n-play strip.

Presently known LED strip controllers are disadvantageous in that the applied PWM signals can induce banding artifacts when a video is taken of the LEDs; that is, vertical lines may appear in the resulting video if the PWM frequency is different from the video frame rate (typically 30 or 60 Hz). To avoid banding, the control module of the present invention applies PWM signals to the LED strip at integer multiples of thirty (30) and at frequencies in the range of 30 Hz to 30 kHz.

In accordance with a further aspect of the invention, overall power consumption and the amplitude of EMF emissions may be reduced by staggering (e.g., phase shifting) the PWM signals applied to each channel while maintaining desired brightness levels in the LEDs. That is, control signals need not be applied to all LED channels simultaneously; indeed, in one embodiment control signals are serially applied to only one channel at a time. Alternatively, the signals may be applied in a manner which minimizes simultaneous transmission using any suitable scheme.

In some existing LED controller schemes, a dedicated PC is used to apply control signals to the LED strip. As a result, when the PC connection is lost, LED control is lost. In accordance with one embodiment of the present invention, the control code resides on the controller itself. Once programmed, the controller controls the LED strip without the need for a PC or additional drivers. That is, once the control instructions are loaded into the LED controller's local memory, the LED controller's on board microcontroller executes the instructions without the need for an external controller such as a PC.

In one embodiment the LED controller comprises a microcontroller, dimmers (LED drivers) implemented as MOSFETs, a power source, and a USB connector. The control module may include several voltage regulators. This allows the user to program the controller using a PC through the USB port without powering the LEDs, or to otherwise carry out programming, testing, administrative functions, and the like without using having to use a USB port.

Those skilled in the art will appreciate that conventional electrical relays do not generate significant heat due to the direct ohmic connection between adjacent conductors. However, the rate at which relays can be toggled (or flickered) is inherently limited due to their mechanical nature. Transistors, on the other hand, desirably operate at high frequencies, but tend to generate substantial thermal energy even at low current levels due to their high internal resistance.

In contrast to presently known LED controllers which transfer heat to an enclosure which houses the controller, the present invention is configured to facilitate heat transfer from the LED controller directly to the structure upon which the controller is mounted along with the LED strip, for example, an aluminum rail which functions as a heat sink. To accomplish this, in various embodiments the dimming transistors are mounted proximate the bottom side of the LED controller circuit board, so that they may be thermally bonded directly to the aluminum rail or other heat sink, thereby eliminating the need for a separate heat sink enclosure.

Referring now to FIG. 1, an interactive kiosk 100 kiosk illustrates an exemplary location 102 for an LED assembly in accordance with various embodiments. The kiosk 100 may also include a display 104 (which may or may not include a touch or otherwise interactive screen), and a speaker and/or microphone module 106.

Figure 2:
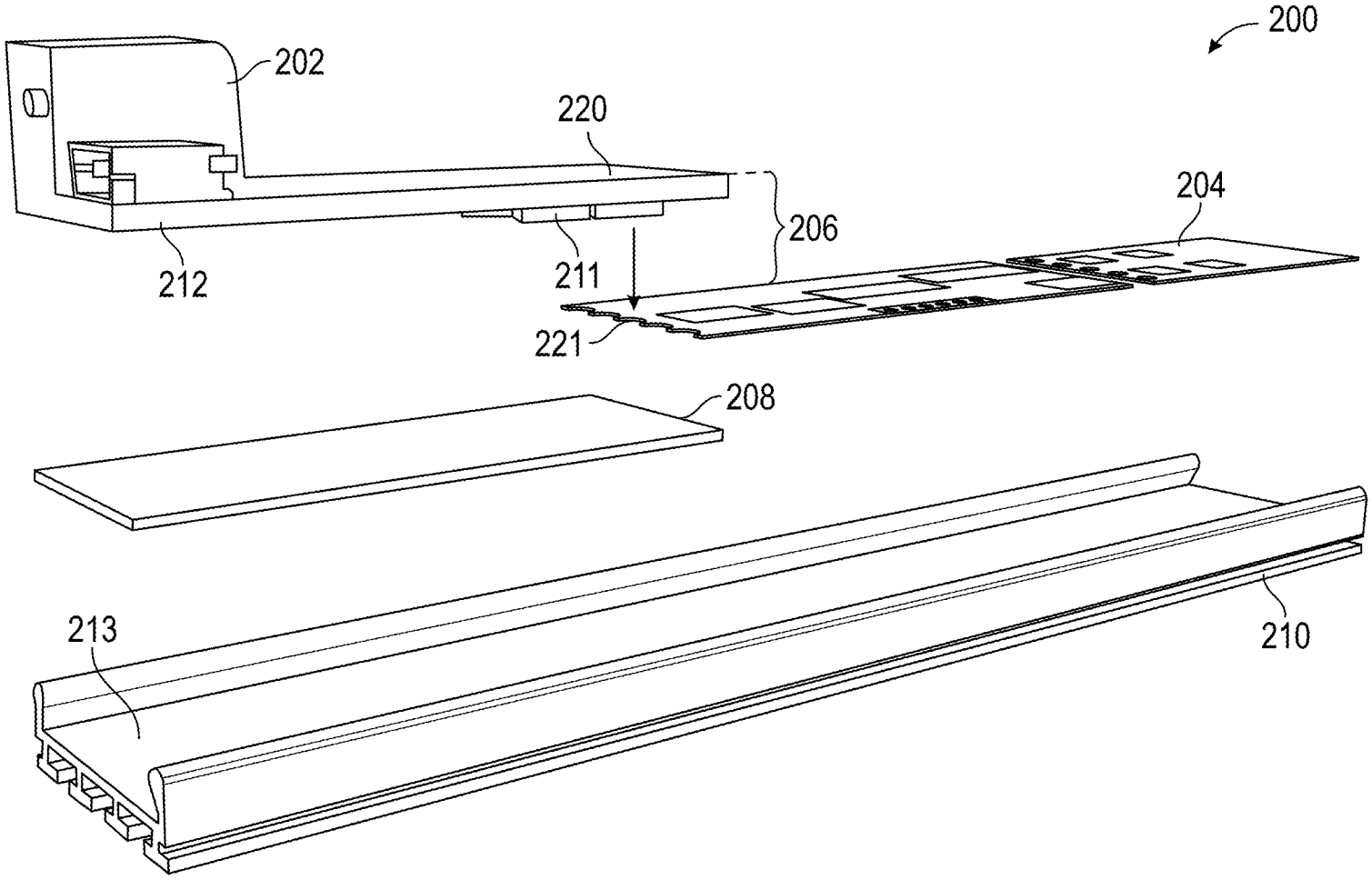
FIG. 2 is an exploded view of an exemplary LED assembly in accordance with various embodiments.

FIG. 2 is an exploded view of an exemplary LED assembly 200 including an LED controller 202, an LED strip 204, a thermal adhesive layer 208, and a supporting channel 210. More particularly, a terminal end 220 of the LED controller 202 may be soldered or otherwise electrically and mechanically connected to a lead wire end 221 of the LED strip 204 at an interface junction 206.

With continued reference to FIG. 2, a plurality of LED drivers 211 which function as dimming transistors are disposed on a bottom surface 212 of the LED controller circuit board, and thermally bonded to a top surface 213 of the aluminum rail or other heat sink (e.g., channel 210). Thermal bonding may be achieved using thermal tape 208, thermal adhesive, or other suitable material. In an embodiment, the thermal adhesive comprises two part thermal glue, such as a medium cure thermally conductive adhesive available from MG chemicals packaged in the form of a 25 mL dual syringe applicator.

Figure 3:
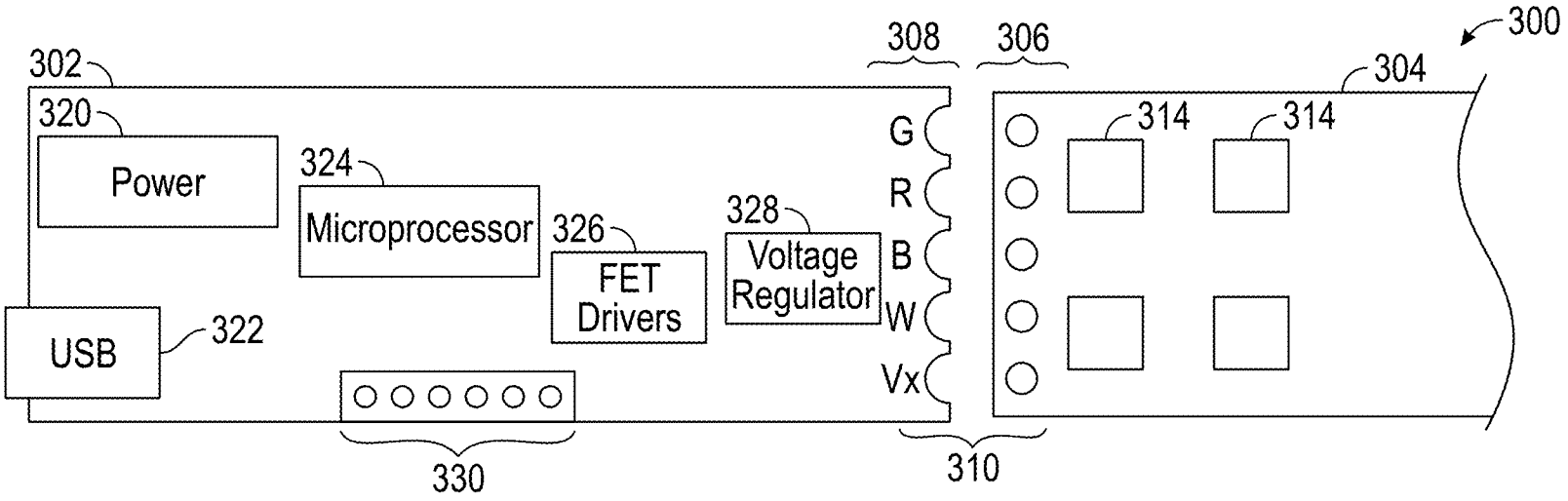
FIG. 3 is a top plan view of an exemplary LED controller and an LED strip in accordance with various embodiments.

FIG. 3 is a top plan view of an exemplary LED strip/controller assembly 300 depicting an LED controller 302 and an LED strip 304. The LED controller comprises a plurality of electronic components mounted to a circuit board. In the illustrated embodiment, the controller includes a terminal interface 308, a power module 320, a USB module 322, a microprocessor 324, an FET driver module 326, a voltage regulator 328, and programming pins 330. In various embodiments, the LED controller further includes a plurality of FETs (not shown in FIG. 3) disposed on the bottom surface of the circuit board.

With continued reference to FIG. 3, the LED strip includes a plurality of individual LEDs 314, and a terminal interface 306 configured for connection to the LED controller terminal interface 308 at a junction 310.

Figure 4:
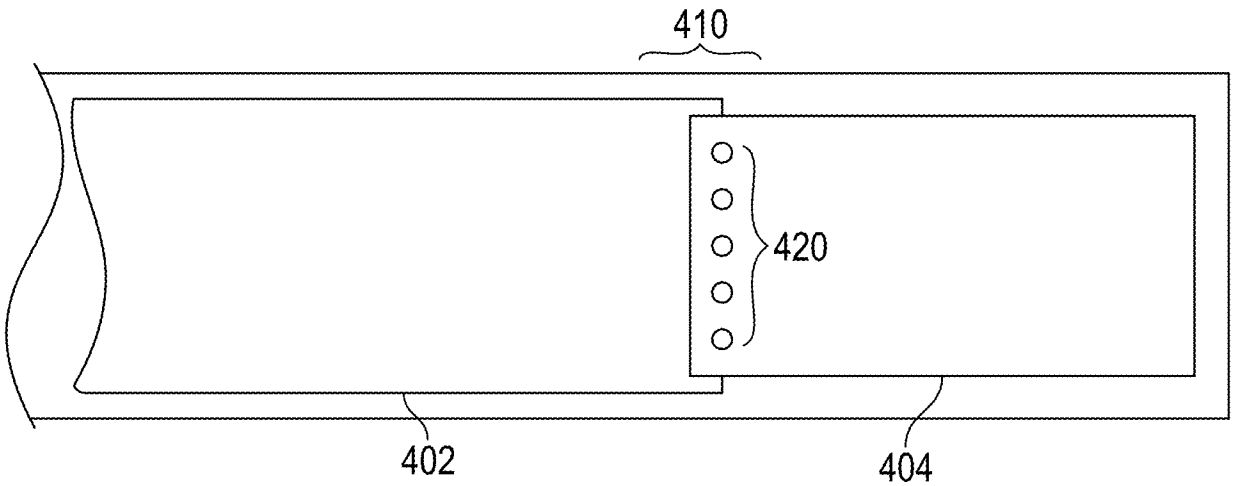
FIG. 4 is a top plan view of the LED strip and LED controller of FIG. 3 with both components secured within a heat sink channel in accordance with various embodiments.

FIG. 4 shows an LED controller 402 soldered to an LED strip 404 at a junction 410 comprising a plurality of individual solder pads 420. In the illustrated embodiment the LED controller and LED strip are secured within a heat sink structure which may be bounded by an end cap (not shown) and enclosed within a diffusing shroud (not shown) to protect the internal components from rain and to avoid unintended contact with people and animals.

Figure 5:
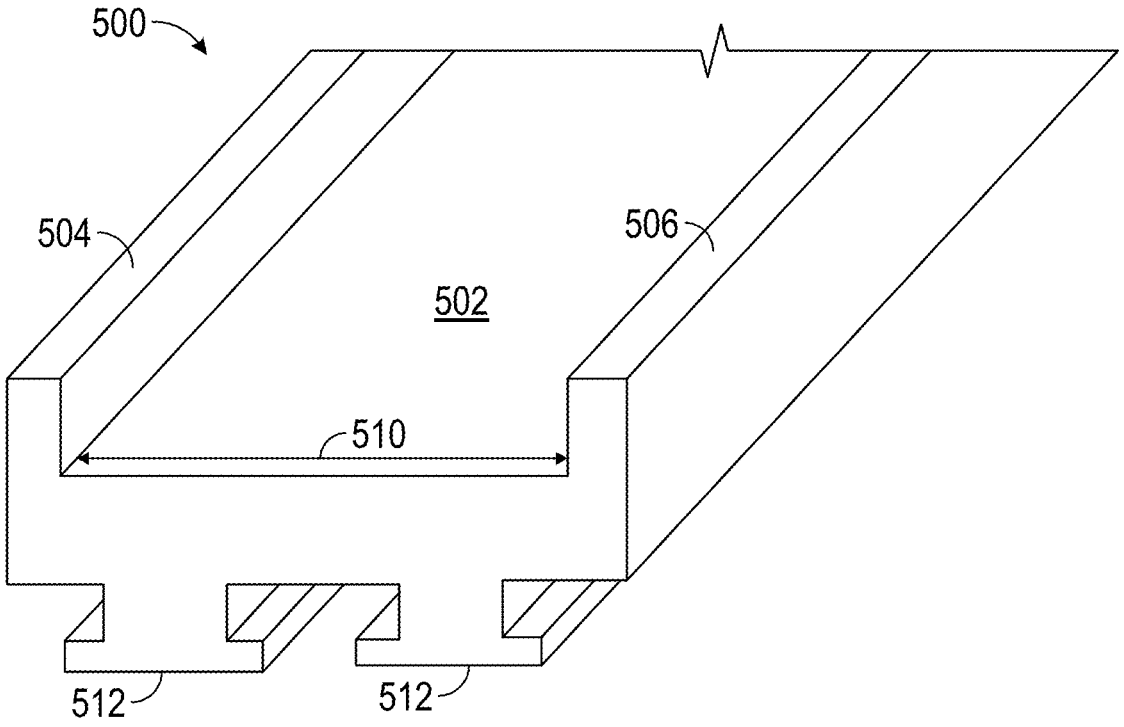
FIG. 5 is an end view of an exemplary LED assembly heat sink in accordance with various embodiments.

Referring now to FIG. 5, an exemplary heat sink structure 500 comprises a channel 502 bounded by left and right side rails 504, 506 and exhibiting a width 510 in the range of 20 millimeters. To facilitate mounting the heat sink to a structure (e.g., a kiosk) and optionally remove thermal energy from the LED controller, the heat sink may include one or more fin structures 512.

Figure 6:
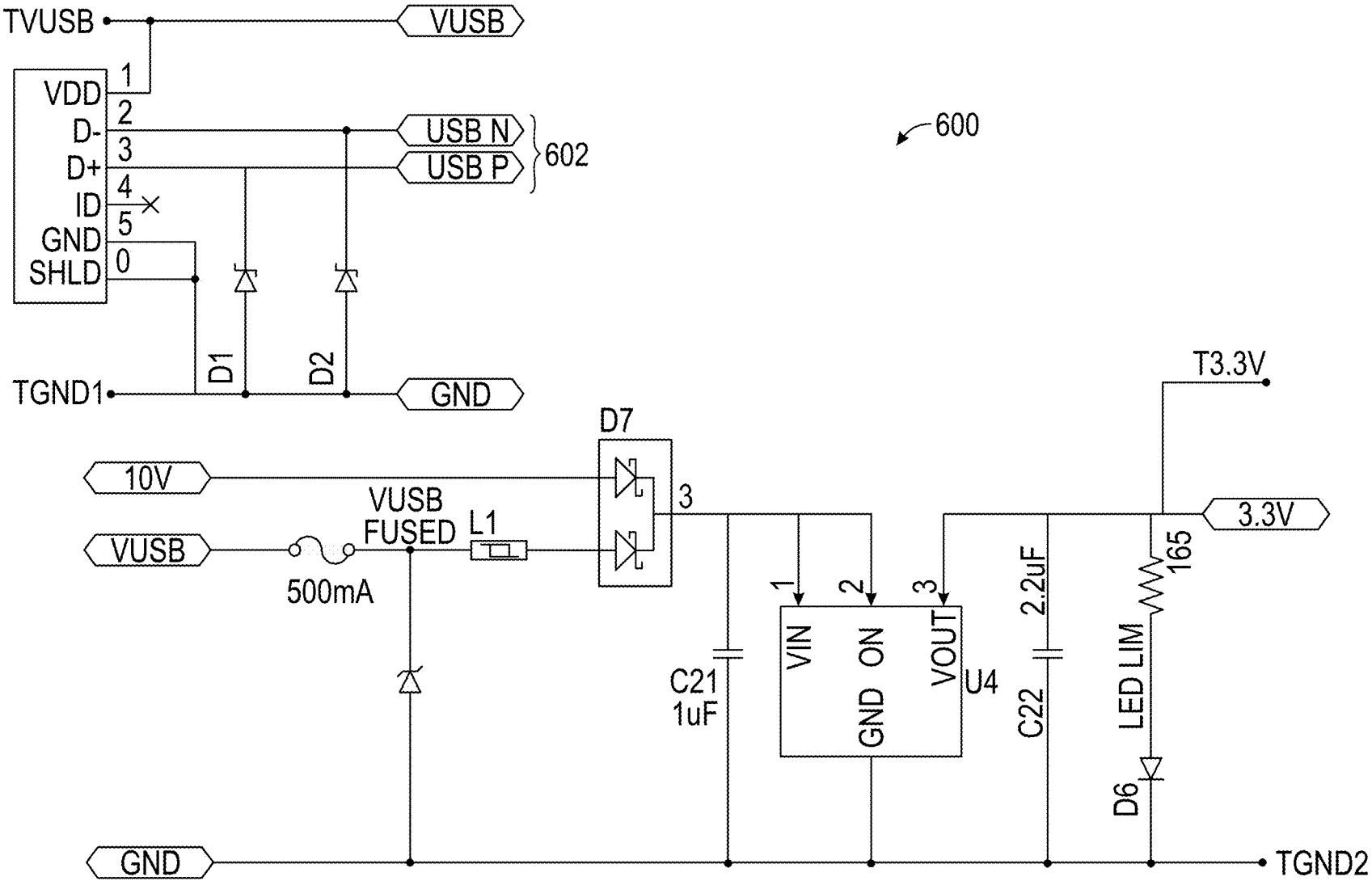
FIG. 6 is an electrical schematic diagram of a USB connection associated with an exemplary LED controller in accordance with various embodiments.

FIG. 6 is an electrical schematic diagram of a USB connection 600 generally corresponding to the USB module 322 shown in FIG. 3. Those skilled in the art will appreciate that the USB module may be connected to a computer from time to time, as needed to upload control commands to an on-board memory device associated with the LED controller. An input/output data port 602 receives external commands and applies corresponding control signals to the microprocessor, as discussed in below in conjunction with FIG. 7. In this way, the color, color transitions, brightness, and other parameters associated with the LED strip may be conveniently controlled.

Figure 7:
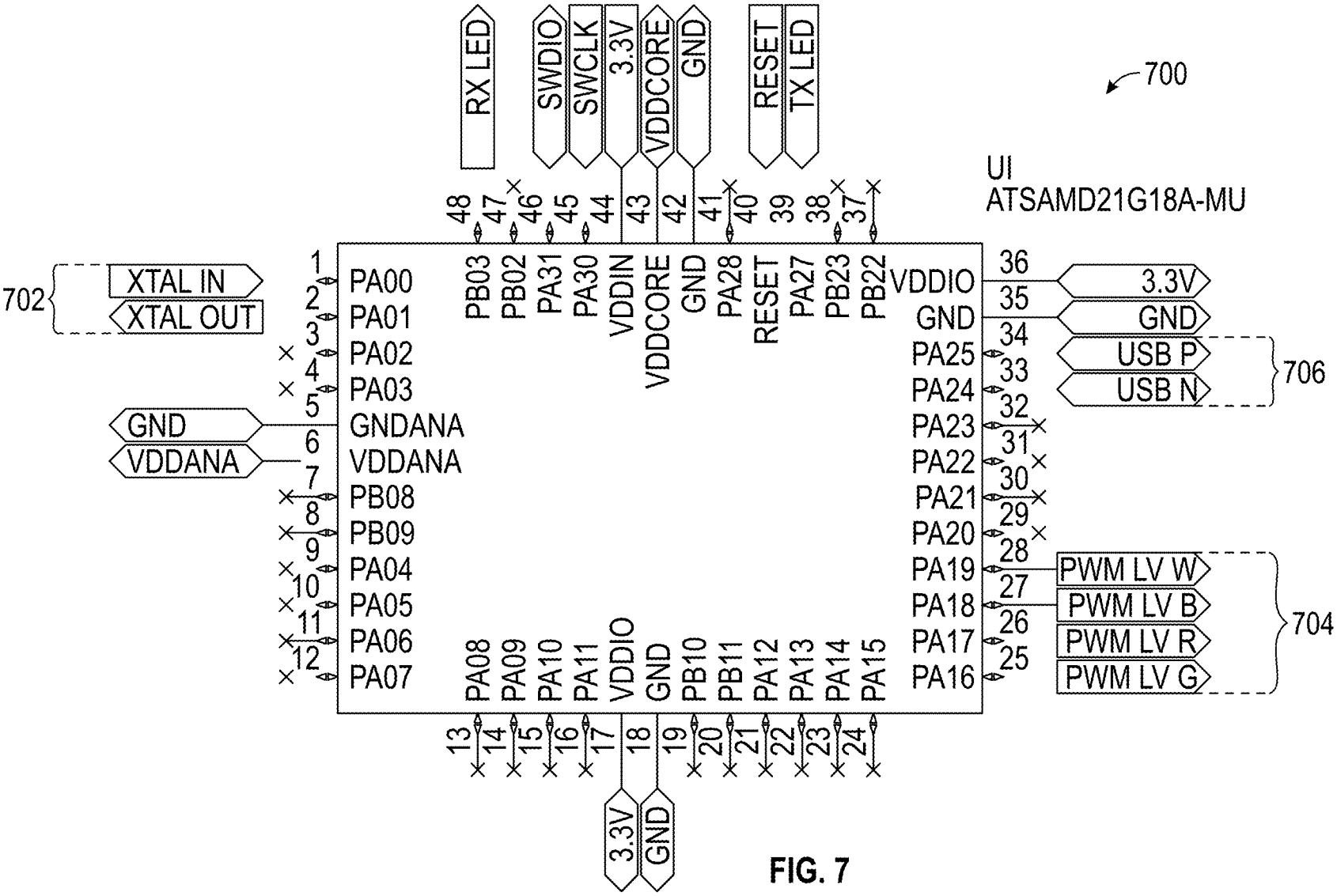
FIG. 7 is an electrical schematic diagram of a microcontroller associated with an exemplary LED controller in accordance with various embodiments.
Figure 7:
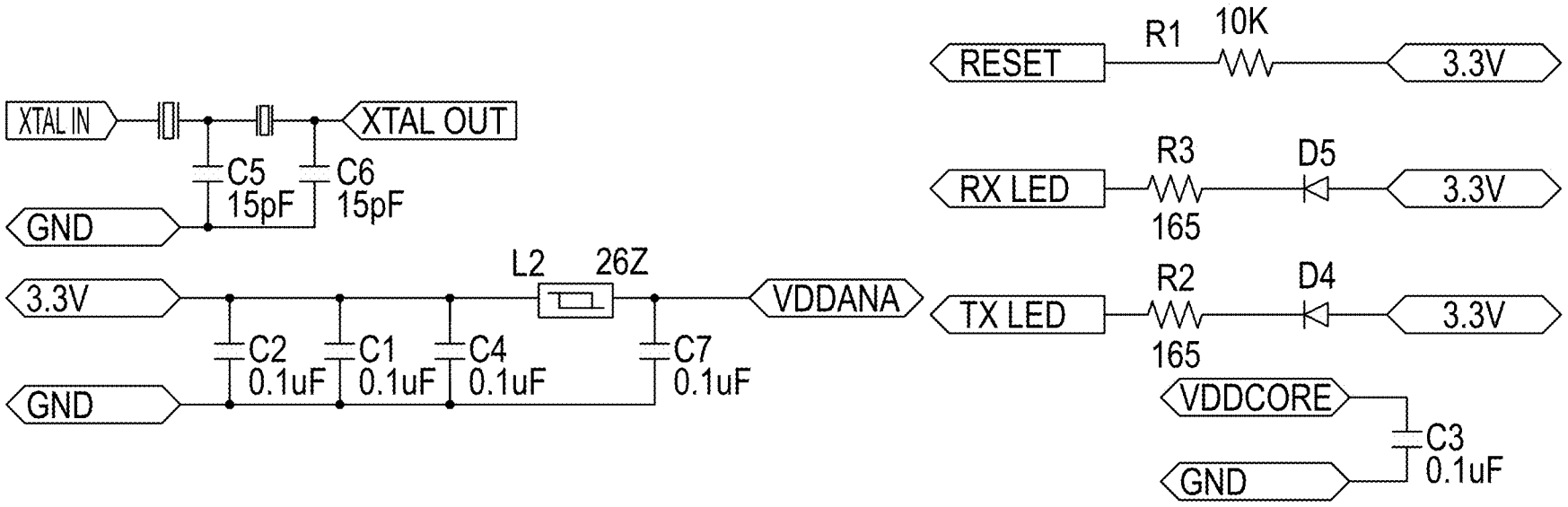

FIG. 7 is a microcontroller 700 including a crystal oscillator (e.g., 16 MHz) 702, a data input/output port 706 configured to communicate with data port 602 of FIG. 6, and respective data channels 704 configured to apply control signals to the FET drivers, as described below in conjunction with FIG. 8.

Figure 8:
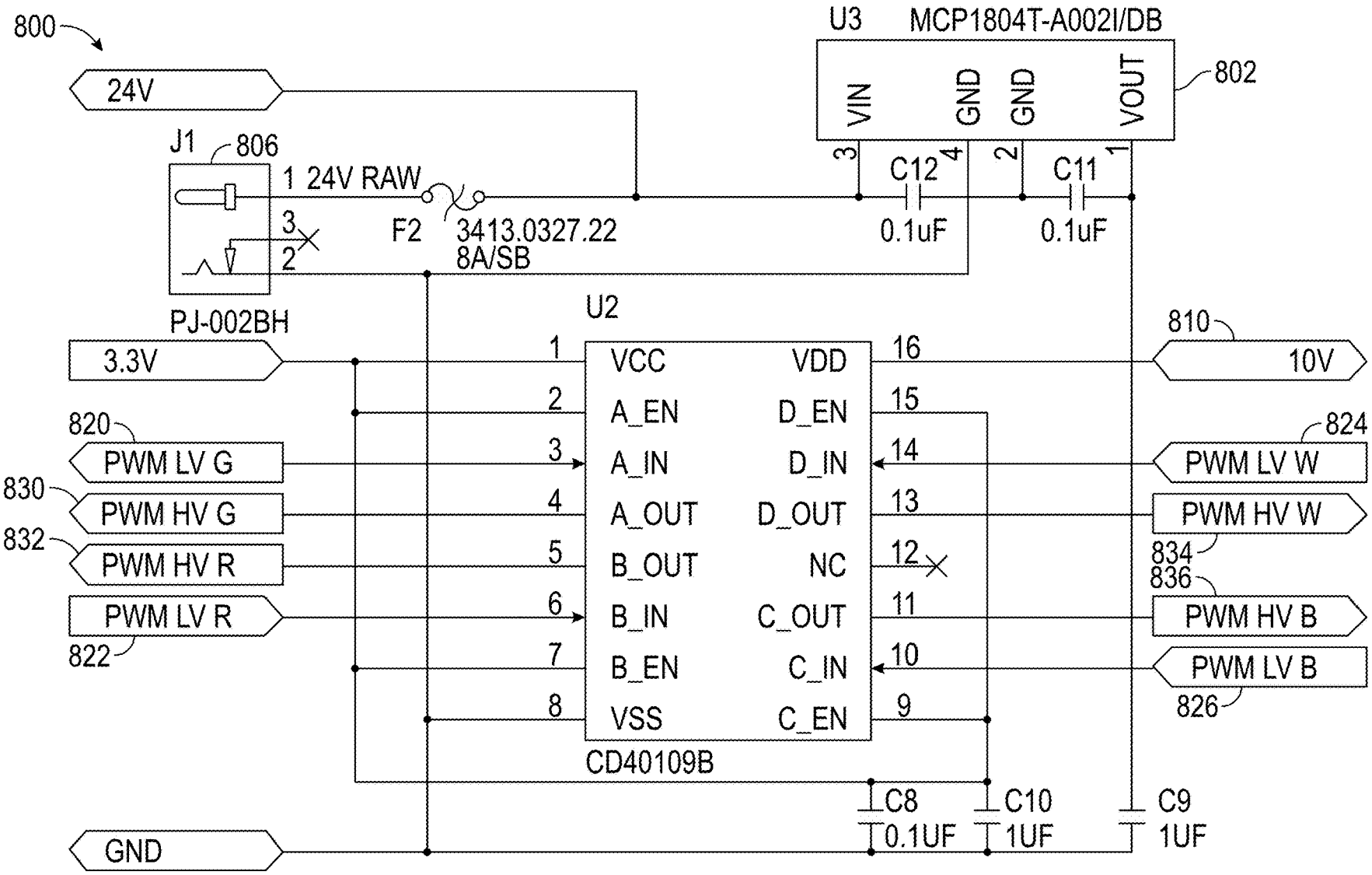
FIG. 8 is an electrical schematic diagram of field effect transistor (FET) drivers associated with an exemplary LED controller in accordance with various embodiments.

FIG. 8 is an electrical schematic diagram of an intermediary driver module 800 comprising, for example, individual metal oxide semiconductor field effect transistor (MOSFET) drivers. The driver module includes a power supply module 806 which may be implemented as a barrel jack, and one or more voltage regulators including voltage regulator 802 configured to receive a 12-24 volt supply from power source 806 and to output 10 volts to the drivers at pin 810.

With continued reference to FIG. 8, the FET driver module 800 further includes a plurality of incoming low voltage (LV) pulse width modulation (PWM) data lines 820, 822, 824, and 826 configured to receive low voltage signals from data channels 704 of FIG. 7. Driver module 800 further includes a plurality of outgoing high voltage (HV) PWM data lines 830, 832, 834, and 836 configured to apply higher voltage control signals to the LED drivers (dimmers) shown in FIG. 9.

Figure 9:
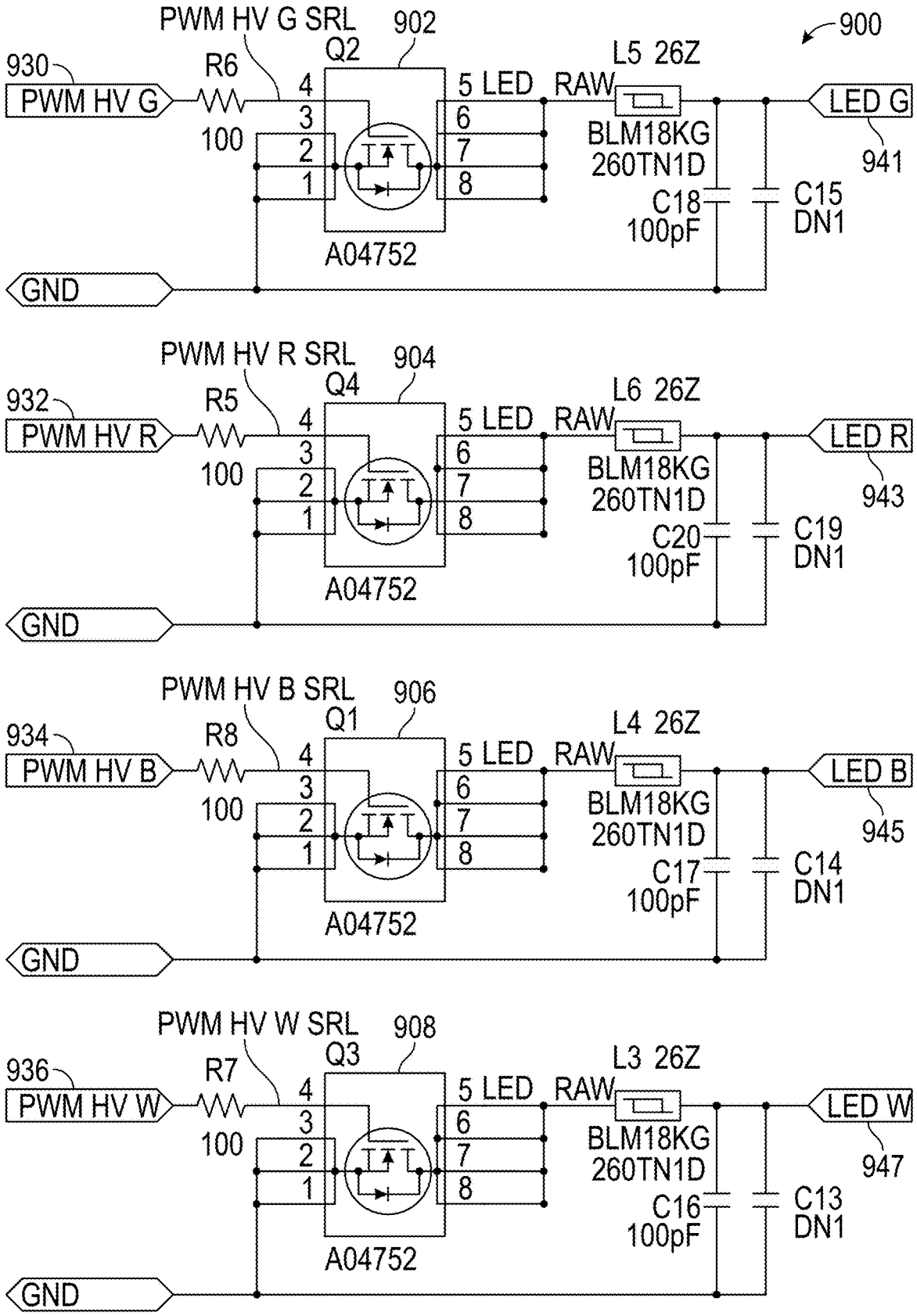
FIG. 9 is an electrical schematic diagram of FET LED drivers associated with an exemplary LED controller in accordance with various embodiments.

Referring now to FIG. 9, an LED driver module 900 includes, for each data channel associated with the LED strip, a transistor (e.g., FET) configured to regulate the voltage drop across and, hence, the current flowing through each LED device. When the LED controller is intended to be connected to a typical four channel LED strip, the LED driver module includes four separate transistors, each configured to receive an input control signal from the FET driver circuit shown in FIG. 8, and to apply an output control signal to a respective channel associated with the LED strip.

More particularly, LED driver module 900 includes a first transistor 902, a second transistor 904, a third transistor 906, and a fourth transistor 908. First transistor 902 comprises a first input data line 930 configured to receive a high voltage PWM signal from output pin 830 of FIG. 8, and a first output data line 941 configured to apply a first voltage signal to a first channel on the LED strip. Second transistor 904 comprises a second input data line 932 configured to receive a high voltage PWM signal from output pin 832 of FIG. 8, and a second output data line 943 configured to apply a second voltage signal to a second channel on the LED strip. Third transistor 906 comprises a third input data line 934 configured to receive a high voltage PWM signal from output pin 834 of FIG. 8, and a third output data line 945 configured to apply a third voltage signal to a third channel on the LED strip. Fourth transistor 908 comprises a fourth input data line 936 configured to receive a high voltage PWM signal from output pin 836 of FIG. 8, and a fourth output data line 947 configured to apply a fourth voltage signal to a fourth channel on the LED strip.

As discussed above, respective transistors 902-908 are suitably disposed on the bottom of the LED controller to facilitate thermal communication with the heat sink structure to which the LED controller is mounted.

Figure 10:
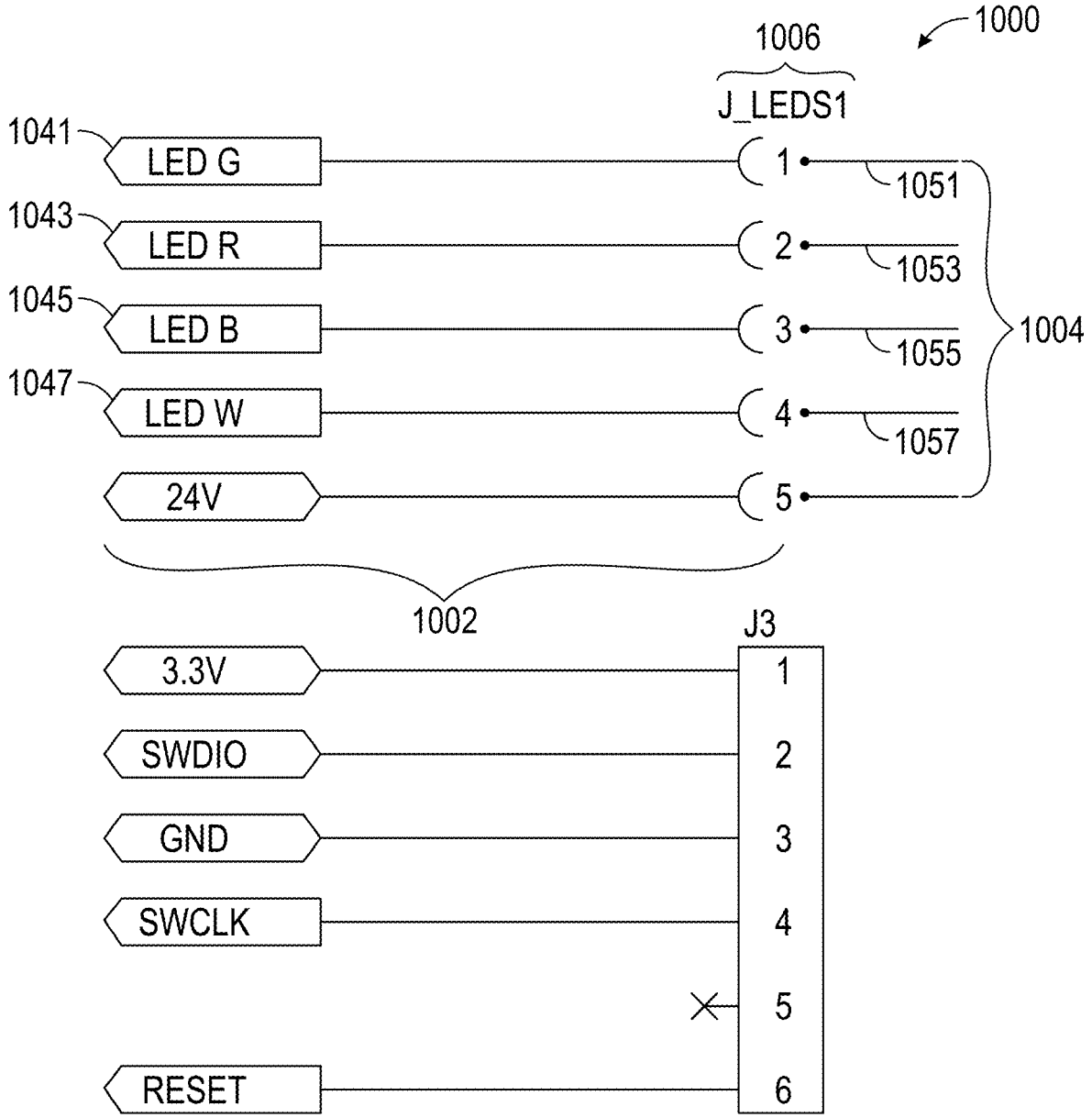
FIG. 10 is an electrical schematic diagram of interface connections between an LED controller and an LED strip in accordance with various embodiments.

FIG. 10 is an interconnect 1000 for providing electrical and/or mechanical connection between an LED controller and an LED strip, and generally corresponds to the interface junction 206 of FIG. 2, the junction 310 of FIG. 3, and the junction 410 of FIG. 4. More particularly, interconnect 1000 includes an LED controller terminal end 1002 and an LED strip terminal end 1004, suitably connected at respective solder joints 1006. The LED controller terminal end 1002 includes a first connection 1041 configured to receive a voltage signal from data line 941 of FIG. 9 and apply it to a first channel 1051 associated with the LED strip. Terminal end 1002 also includes a second connection 1043 configured to receive a voltage signal from data line 943 of FIG. 9 and apply it to a second channel 1053 associated with the LED strip. In addition, terminal end 1002 includes a third connection 1045 configured to receive a voltage signal from data line 945 of FIG. 9 and apply it to a third channel 1055 associated with the LED strip. Finally, terminal end 1002 includes a fourth connection 1047 configured to receive a voltage signal from data line 947 of FIG. 9 and apply it to a fourth channel 1057 associated with the LED strip.

A device for controlling a light emitting diode (LED) strip is thus provided. The device includes: a substantially planar substrate having a first surface and a second surface disposed opposite the first surface; a microprocessor mounted on the first surface; a first driver module mounted on the first surface and configured to receive first control signals from the microprocessor and to generate second control signals; a second driver module mounted on the second surface and configured to receive the second control signals from the first driver module and to generate third control signals; and LED controller terminal end configured to apply the third control signals to an LED strip.

In an embodiment, the substrate comprises a flat circuit board.

In an embodiment, the first surface comprises a top surface and the second surface comprises a bottom surface.

In an embodiment, the first driver module comprises a top surface mounted module including a plurality of metal oxide semiconductor field effect transistors (MOSFETs), and the second driver module comprises a plurality of bottom surface mounted dimming transistors.

In an embodiment, the microprocessor comprises a SAMD21 series microcontroller.

In an embodiment, the device further includes a universal serial bus (USB) connector mounted on the top surface and configured to interface with and receive programming instructions from a computer.

In an embodiment, the device further includes a power input jack and a voltage regulator mounted on the top surface.

In an embodiment, the LED controller terminal end comprises a plurality of connectors each configured to be soldered to a corresponding lead line of an LED strip.

In an embodiment, the plurality of connectors comprises: a red color channel; a green color channel, a blue color channel; a white color channel; and a voltage channel.

An LED assembly is also provided. The LED assembly includes: a flexible LED strip comprising a plurality of LED devices and an LED strip terminal end comprising a plurality of lead wires; an LED controller having an LED controller terminal end configured to be soldered to the plurality of lead wires; a heat sink track to which the LED controller and the LED strip are configured to be mounted; and a thermal adhesive layer disposed between the LED controller and the heat sink track.

In an embodiment, the LED controller further comprises a plurality of dimmer switches disposed proximate the heat sink track.

In an embodiment, the heat sink track comprises a substantially u-shaped channel.

In an embodiment, the heat sink track comprises aluminum.

In an embodiment, the LED controller further comprises: a planar circuit having a first surface and a second surface disposed opposite the first surface; a microprocessor mounted on the first surface; and a first driver module mounted on the first surface and configured to receive first control signals from the microprocessor and to generate second control signals.

In an embodiment, the dimmer switches are mounted on the second surface and configured to receive the second control signals from the first driver module and to apply third control signals to the LED strip terminal end.

In an embodiment, the thermal adhesive layer comprises two part thermal glue.

In an embodiment, the thermal adhesive layer comprises two-sided thermal tape.

In an embodiment, the LED controller further comprises a universal serial bus (USB) connector mounted to the top surface and configured to interface with and receive programming instructions from a computer.

In an embodiment, the LED controller further comprises a power input jack and a voltage regulator, each mounted on the top surface.

An LED assembly is also provided which includes: a substantially u-shaped heat sink channel; an LED strip comprising a plurality of LED devices and a plurality of lead wires mounted within the heat sink channel; an LED controller having a terminal end mechanically and electrically connected to the plurality of lead wires; and a thermal adhesive layer disposed between the LED controller and the heat sink channel.

In an embodiment, the LED controller comprises a bottom surface to which a plurality of transistor switches are mounted, the transistor switches being configured to apply control signals to the plurality of lead wires; and the transistor switches are disposed between the bottom surface and the thermal adhesive layer.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

What is claimed:

1. An LED assembly comprising:

a flexible LED strip comprising a plurality of LED devices and an LED strip terminal end comprising a plurality of lead wires;

an LED controller having an LED controller terminal end configured to be soldered to the plurality of lead wires, wherein the LED controller comprises a bottom surface to which a plurality of transistor switches are mounted, the transistor switches being configured to apply voltage signals to the plurality of lead wires;

a heat sink track to which the LED controller and the LED strip are configured to be mounted; and a thermal adhesive layer disposed between the LED controller and the heat sink track, wherein the transistor switches are disposed between the bottom surface and the thermal adhesive layer.

2. The LED assembly of claim 1, wherein one or more of the transistor switches comprise one or more dimmer switches disposed proximate the heat sink track.

3. The LED assembly of claim 2, wherein the heat sink track comprises a substantially u-shaped channel.

4. The LED assembly of claim 2, wherein the heat sink track comprises aluminum.

5. The LED assembly of claim 2, wherein the LED controller further comprises:

a planar circuit having a first surface and a second surface disposed opposite the first surface;

a microprocessor mounted on the first surface; and a first driver module mounted on the first surface and configured to receive first control signals from the microprocessor and to generate second control signals;

wherein the dimmer switches are mounted on the second surface and configured to receive the second control signals from the first driver module and to apply voltage signals to the LED strip terminal end.

6. The LED assembly of claim 2, wherein the thermal adhesive layer comprises two-part thermal glue.

7. The LED assembly of claim 2, wherein the thermal adhesive layer comprises two-sided thermal tape.

8. The LED assembly of claim 5, wherein the LED controller further comprises a universal serial bus (USB) connector mounted to the top surface and configured to interface with and receive programming instructions from a computer.

9. The device of claim 8, wherein the LED controller further comprises a power input jack and a voltage regulator, each mounted on the top surface.

10. An LED assembly comprising: a substantially u-shaped heat sink channel;

an LED strip comprising a plurality of LED devices and a plurality of lead wires mounted within the heat sink channel;

an LED controller having a terminal end mechanically and electrically connected to the plurality of lead wires, wherein the LED controller comprises a bottom surface to which a plurality of transistor switches are mounted, the transistor switches being configured to apply voltage signals to the plurality of lead wires; and a thermal adhesive layer disposed between the LED controller and the heat sink channel, wherein the transistor switches are disposed between the bottom surface and the thermal adhesive layer.

11. The LED assembly of claim 10, wherein one or more of the transistor switches comprise one or more dimmer switches.

12. The LED assembly of claim 10, wherein the LED strip is flexible.

13. The LED assembly of claim 10, wherein the heat sink track comprises aluminum.

14. The LED assembly of claim 10, wherein the thermal adhesive layer comprises two-part thermal glue.

15. The LED assembly of claim 10, wherein the thermal adhesive layer comprises two-sided thermal tape.

16. A method for an LED assembly comprising:

mounting an LED strip comprising a plurality of LED devices and a plurality of lead wires within a heat sink channel;

mechanically and electrically connecting an LED controller having a terminal end to the plurality of lead wires, wherein the LED controller comprises a bottom surface to which a plurality of transistor switches are mounted, the transistor switches being configured to apply voltage signals to the plurality of lead wires; and disposing a thermal adhesive layer between the LED controller and the heat sink channel, wherein the transistor switches are disposed between the bottom surface and the thermal adhesive layer.

17. The method of claim 16, wherein the LED controller further comprises a plurality of dimmer switches disposed proximate the heat sink track.

18. The method of claim 16, wherein the LED strip is flexible.

19. The method of claim 16, wherein the heat sink track is a substantially u-shaped channel and comprises aluminum.

* * * * *